United States Patent [19]

Folsom et al.

[11] 4,070,972

[45] Jan. 31, 1978

[54] CARRIER PROPELLING MECHANISM FOR POWER AND FREE CONVEYORS

[75] Inventors: Harold A. Folsom, Livonia; David G. Bilson, Detroit, both of Mich.

[73] Assignee: Jervis B. Webb Company, Farmington Hills, Mich.

[21] Appl. No.: 711,403

[22] Filed: Aug. 3, 1976

[51] Int. Cl.[2] ..... B61B 10/02

[52] U.S. Cl. ..... 104/172 S; 104/96; 104/98; 104/127; 198/485; 198/738; 214/16.1 DB

[58] Field of Search ..... 214/16.1 D, 16.1 DB, 214/16.1 CF, 16.4 A, 730; 104/172 R, 172 S, 162, 127, 128, 129, 48, 50, 96, 98; 198/738, 741, 736, 485

[56] References Cited

U.S. PATENT DOCUMENTS

| | | | |
|---|---|---|---|
| 2,791,338 | 5/1957 | Thaon De Saint-Andre | 214/16.1 DB |
| 3,926,125 | 12/1975 | Orwin | 104/172 S X |

FOREIGN PATENT DOCUMENTS

| | | | |
|---|---|---|---|
| 1,314,864 | 12/1962 | France | 214/730 |
| 449,186 | 9/1927 | Germany | 198/736 |
| 833,174 | 3/1952 | Germany | 214/16.1 DB |
| 1,811,635 | 6/1970 | Germany | 214/16.4 A |
| 6,600,298 | 7/1966 | Netherlands | 214/16.4 A |
| 133,914 | 4/1960 | U.S.S.R. | 104/50 |

*Primary Examiner*—Robert J. Spar
*Assistant Examiner*—Randolph A. Reese
*Attorney, Agent, or Firm*—Joseph W. Farley

[57] ABSTRACT

Propelling mechanism for forwarding a carrier of a power and free conveyor from the delivery end of a first carrier supporting track onto a track section of an elevator and thence onto the receiving end of a second carrier supporting track. The elevator includes a carriage to which the track section is attached and which is movable longitudinally to permit the track section to be extended from the elevator into registry with either the first or second carrier supporting track. A propelling member, consisting of a pair of roller chains connected in spaced side-by-side relation, is equipped at one end with a carrier pusher, is connected at the other end to an endless output chain of a reversible drive mounted on the carriage, and is supported and guided by tracks which extend parallel to the track section from the entrance end thereof and into a storage path parallel to the path of the endless output chain. When the drive is operated in the reverse direction, the pusher-equipped end of the propelling member is extended from the storage path toward the delivery end of the first carrier supporting track until a carrier is engaged by the pusher. Operating the drive in the forward direction causes the carrier to be forwarded along the track section until the propelling member is returned to the storage path, when additional pushers mounted on the endless output chain are successively engageable with trolleys of a multiple-trolley carrier. These pushers are operable to forward such a carrier from the track section to the receiving end of the second carrier supporting track.

17 Claims, 12 Drawing Figures

CARRIER PROPELLING MECHANISM FOR POWER AND FREE CONVEYORS

This invention relates to improvements in propelling mechanism for forwarding a carrier of a power and free conveyor along a carrier supporting track section employed in some portion of a power and free conveyor system where it is not practical to propel a carrier in the conventional manner by a power-driven chain equipped with pushers, one of which engages a driving dog on a carrier.

An example of such a portion of a power and free conveyor system is an elevator employed to transport carriers from the delivery end of a first carrier supporting track to the receiving end of a second carrier supporting track located at a different level. Propulsion along the first and second carrier supporting tracks is accomplished by the conventional pusher-equipped chain. The elevator includes a carriage to which the track section is attached and which is movable in directions longitudinal of the track section so that the entrance end thereof can be placed in registry with the delivery end of the first carrier supporting track and so that the exit end thereof can be placed in registry with the receiving end of the second carrier supporting track. When the entrance end of the track section is so placed in registry with the delivery end of the first carrier supporting track, the propulsion mechanism of the invention is operable to forward a carrier from the delivery end of the first carrier supporting track onto the track section; and, is thereafter operable to forward the carrier from the track section onto the receiving end of the second carrier supporting track after the track section has been placed in registry therewith by operation of the elevator and the carriage.

Although the propulsion mechanism of the invention has particular utility in the forwarding of a carrier onto a movable track section mounted in an elevator, as described above and to be hereafter illustrated in further detail, the utility of the propulsion mechanism is not confined to this setting. It will therefore be understood that the term "track section" as used herein is intended to include any section of carrier supporting track of a power and free conveyor where it is necessary or desirable to use some form of carrier propulsion other than the conventional pusher-equipped chain.

According to the invention, there is provided in a power and free conveyor including a carrier and a carrier supporting track section having an entrance end and an exit end, propelling mechanism for forwarding the carrier along the track section toward the exit end thereof, the propelling mechanism comprising a double-ended flexible propelling member, one end of the propelling member being equipped with a carrier pusher; means for supporting the propelling member including storage means and track means, the track means extending from the storage means toward the entrance end of the track section in parallel relation thereto and defining for the propelling member a linear path of movement in which the carrier pusher is engageable in forwarding relation with a carrier; and drive means operable in a reverse direction to extend the pusher equipped end of the propelling member from the storage means along the track means toward the entrance end of the track section, and operable in a forwarding direction to return the propelling member to the storage means whereby a carrier engaged by the pusher is forwarded along the track section.

Preferably said drive means includes a pair of sprockets, an endless output chain trained about said sprockets, a driving connection from the output chain to the propelling member adjacent the other end thereof, and the storage means comprises storage track means for guiding the propelling member in a storage path of travel parallel to the path of travel of said output chain.

According to another feature of the invention, the storage track means extends from and returns to the track means and forms an endless storage path which includes a portion of the track means, and the output chain of the drive means is provided with holdback means engageable by a carrier on the track section and with pusher means for forwarding a carrier along the track section after the propelling member has been returned to said storage means.

Other features and advantages of the invention will appear from the description to follow of the representative embodiment disclosed in the accompanying drawings.

DESCRIPTION OF THE PREFERRED EMBODIMENT

Figure 1:
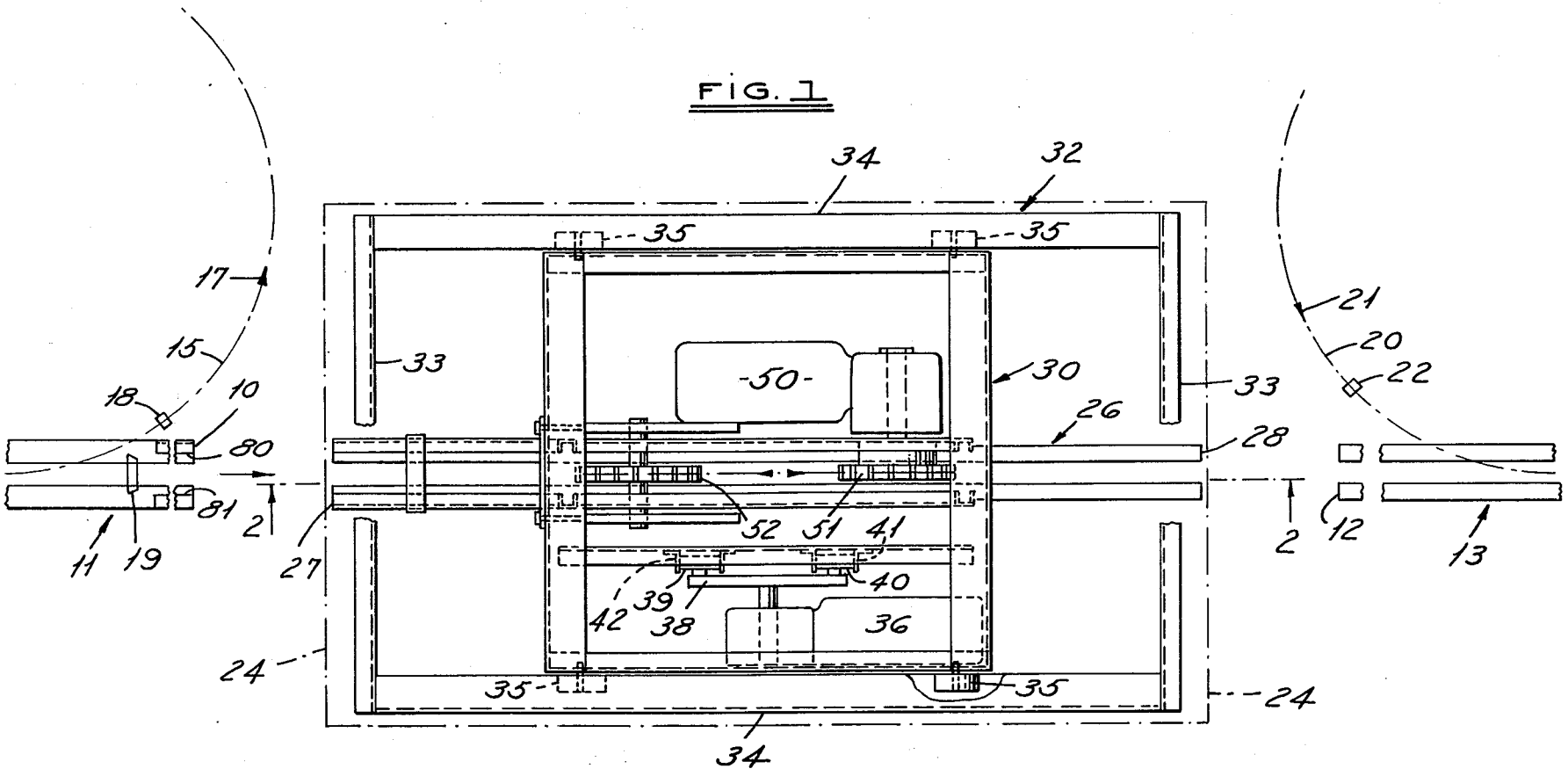
FIG. 1 is a plan view showing a portion of a power and free conveyor system including the delivery end of a first carrier supporting track, the receiving end of a second carrier supporting track and an elevator equipped with a movable carriage on which a track section and the propelling mechanism of the invention are mounted.
Figure 2:
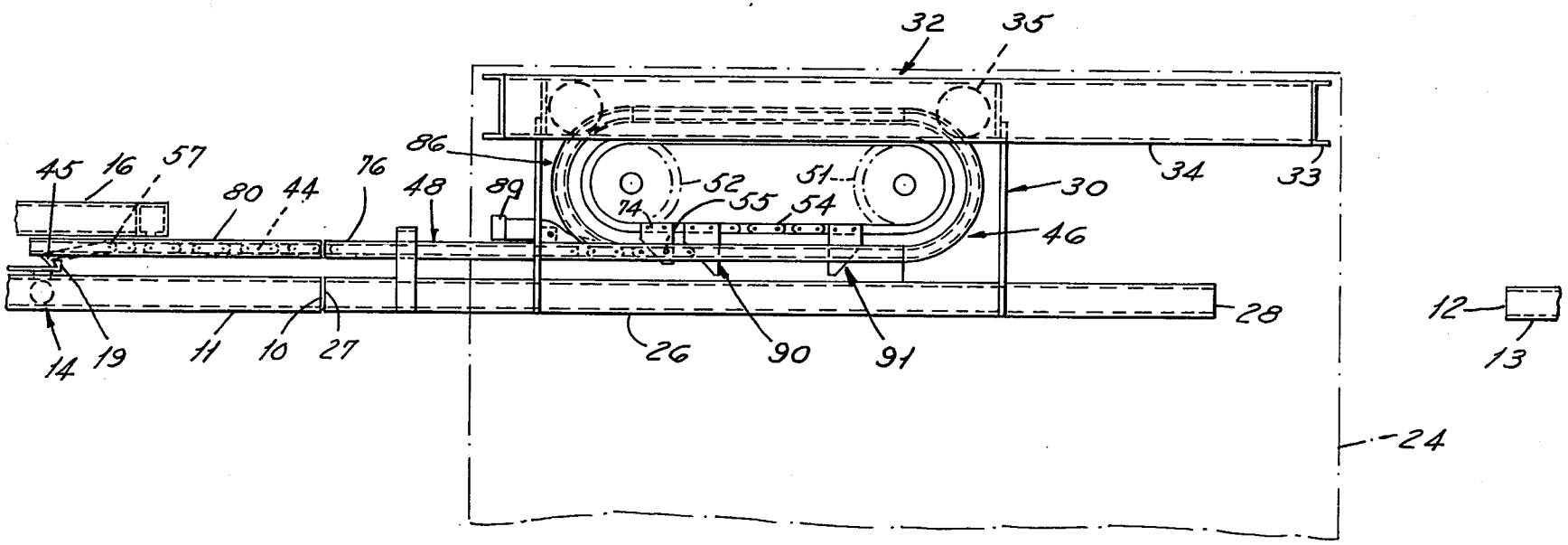
FIG. 2 is a sectional elevation, taken substantially as indicated by the line 2—2 of FIG. 1, and showing the track section extended into registry with the delivery end of the first carrier supporting track with the propelling mechanism of the invention engaging a carrier thereon.

FIGS. 1 and 2 show a portion of a power and free conveyor system including the delivery end 10 of a first carrier supporting track 11 (shown at the left) and the receiving end 12 of a second carrier supporting track 13 (shown at the right). A carrier 14 is propelled along the track 11 by a chain 15 which is supported by a track 16, is driven in the direction of the arrow 17 and is equipped with a plurality of pushers 18, one of which engages a driving dog 19 on the carrier 14. The second carrier supporting track 13 is also provided with a track supported chain 20 driven in the direction of the arrow 21 and equipped with a plurality of pushers 22 for propelling carriers.

An elevator 24 travels vertically between the ends 10 and 12 of the first and second carrier supporting tracks 11 and 13. These tracks have been shown at the same horizontal level for simplicity of illustration only, since in actual practice the number and arrangement of the tracks will depend upon the requirements of a particular system. For example, the system could include a plurality of second or receiving carrier supporting tracks 13 arranged at levels which differ from the level of the first or delivering track 11; or, the arrangement shown could be duplicated on a plurality of different vertical levels so that the carriers could be transported by the elevator from any level to any other level desired.

Because of the vertical elevator movement and the space required for the elevator and its supporting and enclosing structure (not shown) it is necessary to diverge the forwarding chain 15 from the path of the track 11 and to converge the receiving chain 21 with the track 13.

A carrier supporting track section 26 having an entrance end 27 and an exit end 28 is operatively associated with the elevator 24, being attached to a carriage 30 which in turn is supported by a frame 32 suitably mounted in the elevator. The frame 32 includes a pair of end members 33 and a pair of side rails 34 engaged by wheels 35 of the carriage 30. A drive unit 36, suitably carried by the frame 32, has an output shaft 37 and a double arm crank 38 provided with drive rollers 39 and 40. The drive unit 36 is reversible, and when operated in one direction with the carriage 30 in the centered position shown, the drive roller 40 engages between one pair of guides 41 attached to the carriage, causing the carriage to move to the left from the position shown in FIG. 1. When the drive unit 36 is operated in the opposite direction, the roller 39 engages between another pair of guides 42 attached to the carriage, shifting the carriage to the right from the position shown. Movement of the carriage to the left enables the entrance end 27 of the track section 26 to be registered with the delivery end 10 of the track 11, while movement of the carriage to the right enables the exit end 28 of the track section 26 to be registered with the receiving end 12 of the track 13. The propelling mechanism for forwarding a carrier 14 along the track section 26 toward the exit end 28 thereof essentially comprises a double-ended flexible propelling member or chain 44 (FIG. 2) equipped with a carrier pusher 45 at one end thereof; means for supporting the propelling member 44 including storage means 46 and track means 48, the track means 48 extending from the storage means 46 toward the entrance end 27 of the track section 26 in parallel relation thereto and defining for the propelling member 44 a linear path of movement in which the carrier pusher 45 is engageable in forwarding relation with a carrier 14. Drive means including a reversible motor unit 50 (FIG. 1), a pair of sprockets 51 and 52 to one of which the motor unit 50 is connected, an output chain 54 trained about the sprockets, and a driving connection 55 from the output chain 54 to the propelling member 44 adjacent the other end 56 thereof, is operable in a reverse direction to extend the pusher equipped end 57 of the propelling member 44 from the storage means 46 along the track means 48 toward the entrance end of the track section 26, and is operable in a forwarding direction to return the propelling member 44 to the storage means 46, thus forwarding a carrier 14 engaged by the pusher 45 along the track section 26.

Figure 3:
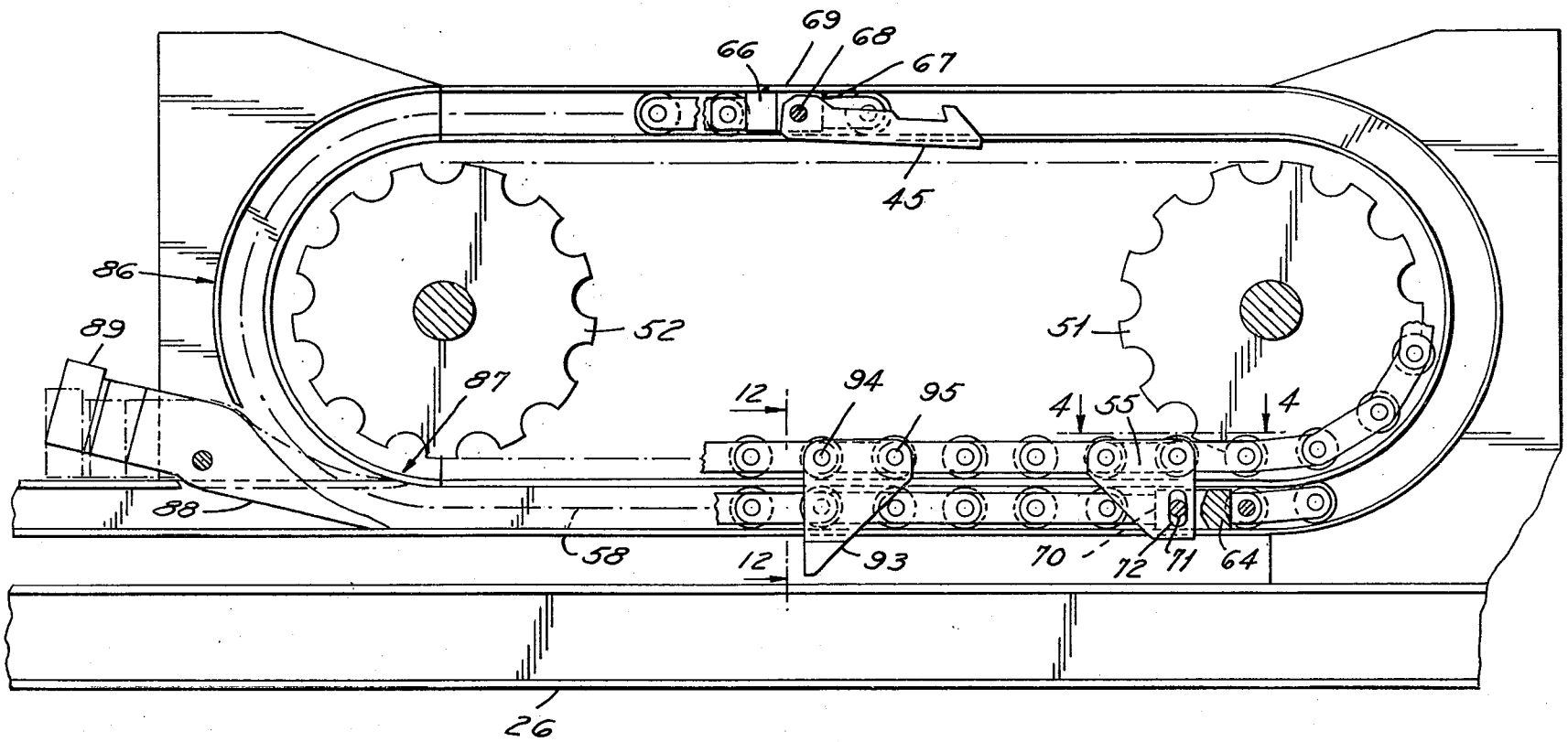
FIG. 3 is an enlarged sectional elevation of the propelling mechanism.
Figure 4:
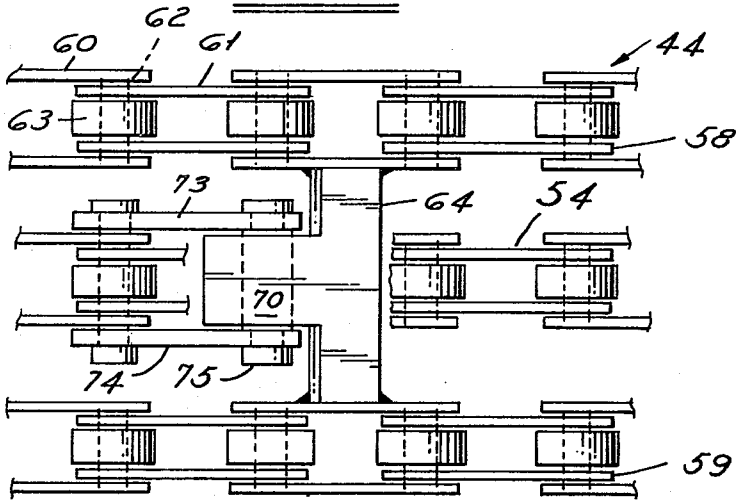
FIG. 4 is an enlarged plan view, taken as indicated by the line 4—4 of FIG. 3, showing the connection between the propelling member chains and the output chain of the drive unit.
Figure 11:
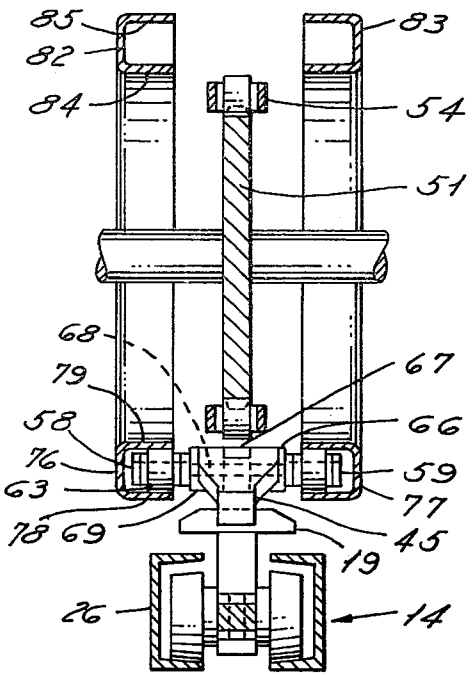
FIG. 11 is an enlarged sectional elevation taken as indicated by the line 11—11 of FIG. 6 and showing the track section and the chain supporting tracks of the propelling mechanism; and, FIG. 12 is an enlarged sectional detail taken as indicated by the line 12—12 of FIG. 3 illustrating the mounting of a holdback member on the output chain of the drive unit.

Referring to FIGS. 3, 4, 11 and 12, the propelling member 44 in the construction illustrated comprises a pair of chains 58 and 59 each composed of a series of links 60 and 61 connected by pivots 62, with rollers 63 mounted on the pivots. The chains 58 and 59 are connected in spaced side-by-side relation by suitable means such as the cross member 64 shown in FIG. 4 and the cross member 66 shown in FIG. 11. The cross member 66 is located adjacent to the pusher-equipped end of the chains 58 and 59 and includes a tongue 67 to which a bifurcated end on the pusher 45 is attached by a pivot 68. This construction is also shown in FIG. 3, and a stop 69 is mounted on one side of the tongue 67 to limit pivotal movement of the pusher 22 towards the carrier drive dog 19, as shown in FIG. 11. A tongue 70 (FIG. 4) is also provided on the cross member 64 and carries a pin 71 which engages a slot 72 in each of a pair of plates 73 and 74 attached by pivot pins 75 to the output chain 54, thereby forming the driving connection between the output chain 54 and the propelling member chains 58 and 59. This driving connection is thus located intermediate the chains 58 and 59 as also is the carrier pusher 22 (FIGS. 4 and 11). The output chain 54 is also composed of a series of links connected by pivots provided with rollers; and, this chain has the same pitch as that of each of the chains 58 and 59. When the chains 58 and 59 are connected together, and in turn connected to the chain 54, the axes of the pivot pins of all the chains are in substantially transverse alignment, as shown in FIG. 4.

FIGS. 1, 2, 3 and 11 show that the track means 48 which extends toward the entrance end 27 of the track section 26 for supporting the chains 58 and 59 of the propelling member 44 consists of a pair of tracks 76 and 77 each having supporting and guiding rails 78 and 79 engageable by the rollers 63 of the chains. At the entrance end 27 of the track section 26, the rails 76 and 77 are registerable with corresponding rails 80 and 81 mounted above the rails of the first carrier supporting track 11. These rails 80 and 81 extend from the delivery end 10 of the track 11 a distance sufficient to permit the pusher 45 of the propelling member 44 to be extended into engagement with a carrier dog 19 which has lost driving engagement from a pusher 18 of the diverging power chain 15 (FIG 1).

As shown in FIGS. 2, 3 and 11, the storage means 46 includes a pair of storage tracks 82 and 83 which extend from the tracks 76 and 77 and guide the propelling member chains 58 and 59 in a storage path of travel parallel to the path of travel of the output chain 54. The storage tracks 82 and 83 have supporting and guiding rails 84 and 85 and have return portions 86 which rejoin the tracks 76 and 77 at a junction 87 to form an endless storage path whose length exceeds the length of the propelling member chains 58 and 59. Switch means 88 are mounted at the junction 87 and are normally biased by a counterweight 89 to a position in which the junction is closed to the return path 86.

Figure 12:
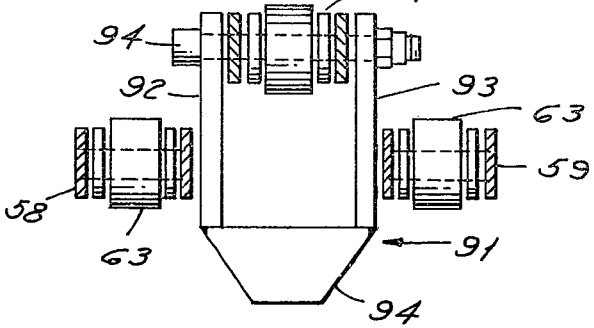

The propelling mechanism disclosed additionally includes a plurality of pusher means 90 and holdback means 91 provided on the output chain 54, as shown in FIGS. 2, 3 and 12. Each of these pusher and holdback means 90 and 91 includes a pair of plates 92 and 93 connected by pivot pins 94 and 95 to the links of the chain 54. The side plates 92 and 93 extend between the chains 58 and 59 and a pusher member or holdback member 94 is secured to the projecting ends of the side plates.

Operation of the propelling mechanism is illustrated in sequence in FIGS. 5–10. Each of these schematic views show the propelling member 44 (including the chains 58 and 59) as a heavy solid line, omit the supporting and storage tracks for the propelling member 44, and merely indicate the path of travel of the components of the propelling mechanism and their relative positions at different stages in their operation.

Figure 5:
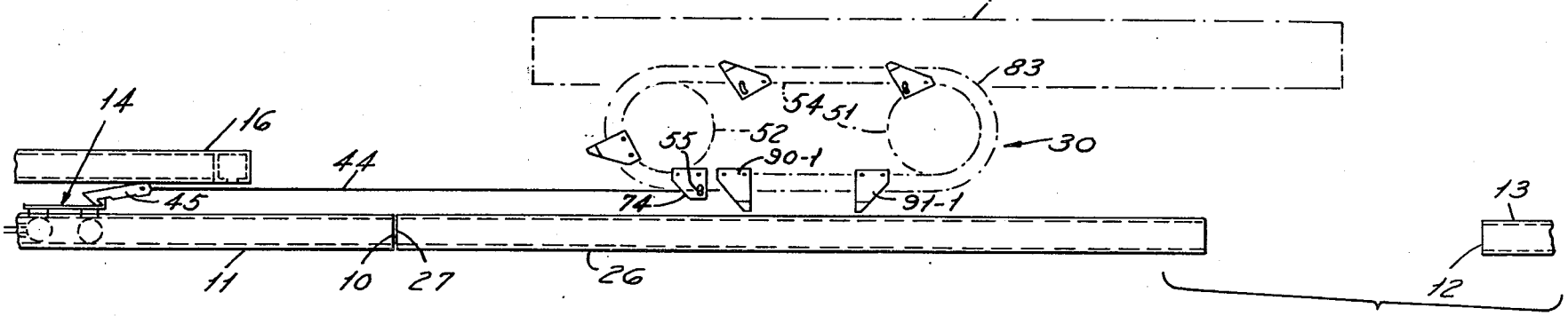
FIG. 5 is a schematic elevation showing the propelling mechanism extended to engage a carrier on the delivery end of a first carrier supporting track.

FIG. 5 shows the various components at the start of an operation of transferring a carrier 14 from the delivery end of the first carrier supporting track 11 onto the track section 26. By movement of the carriage 30 on the frame 32, the track section 26 has been shifted to the left to place its entrance end 27 in registry with the delivery end 10 of the first carrier supporting track 11. By operation of the drive means for the propelling member 44 in a reverse direction, the pusher-equipped end 45 of the propelling member 44 has been extended over the first supporting track 11 and the driving dog 19 of a carrier 14 has been engaged by the pusher 45.

Figure 6:
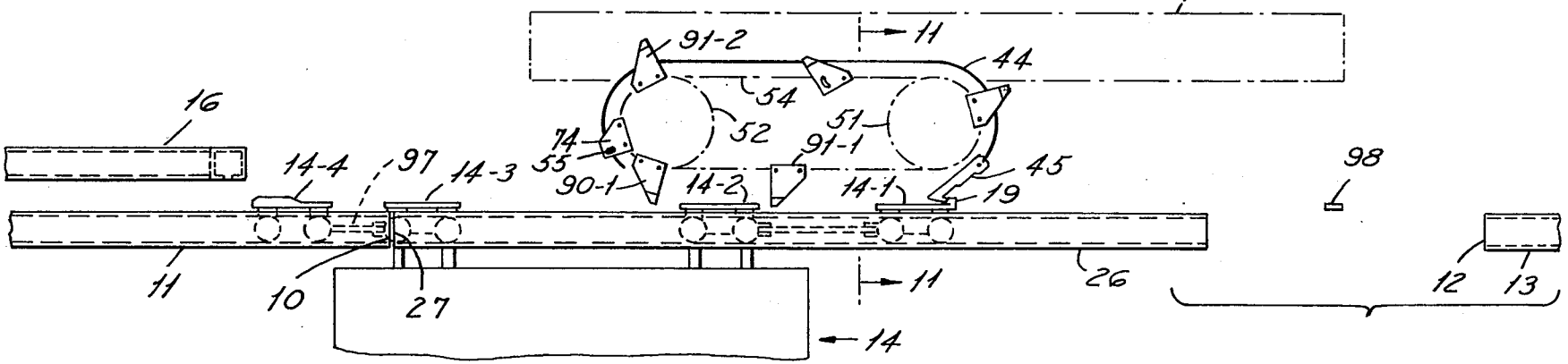
FIG. 6 is a schematic elevation similar to FIG. 5 showing the carrier being advanced onto the track section.

FIGS. 6–10 show the results of an ensuing operation of the drive means for the propelling member 44 in a forwarding direction. In FIG. 6, the propelling member 44 has been returned from its extended position of FIG. 5 into the storage means, and the pusher 45 is about to disengage from the dog 19 of the carrier 14. The carrier 14 is composed of a leading trolley 14-1 followed by a pair of load carrying trolleys 14-2 and 14-3 and by a trailing trolley 14-4, the leading trolley 14-1 being connected to the first load carrying trolley 14-2 by a towbar 96 and the trailing trolley 14-4 being connected to the second load carrying trolley 14-3 by a towbar 97. A holdback member 91-1 on the output chain 54 has moved to a position preceding the trolley 14-2 and a pusher member 90-1 on the output chain 54 is moving into a position following the trolley 14-2.

Figure 7:
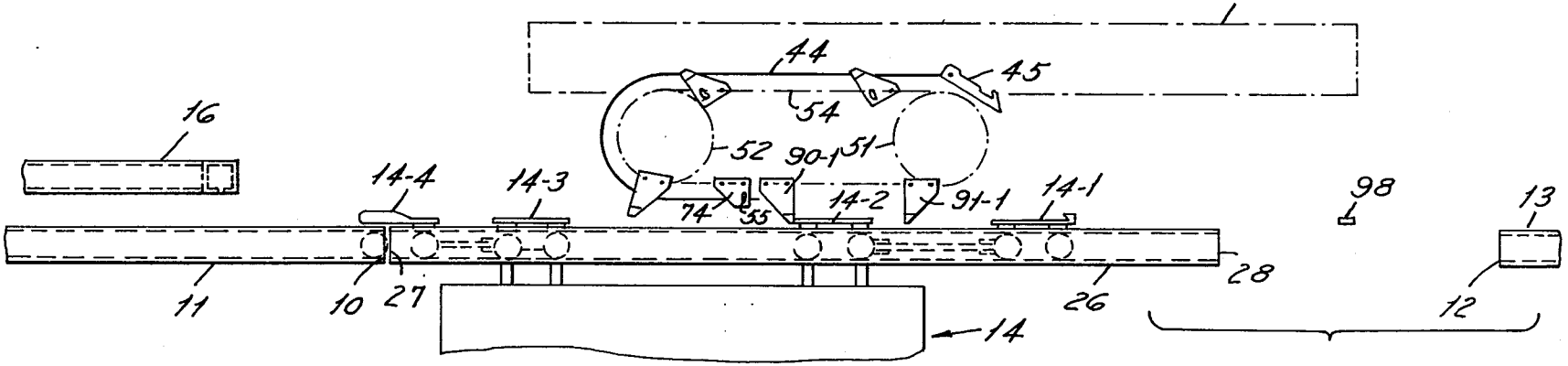
FIG. 7 is a similar elevation illustrating further advancement of the carrier onto the track section.

In FIG. 7, further forwarding of the carrier 14 toward the exit end 28 of the track section 26 is being accomplished by engagement of the carrier trolley 14-2 by the pusher member 90-1 on the output chain 54.

Figure 8:
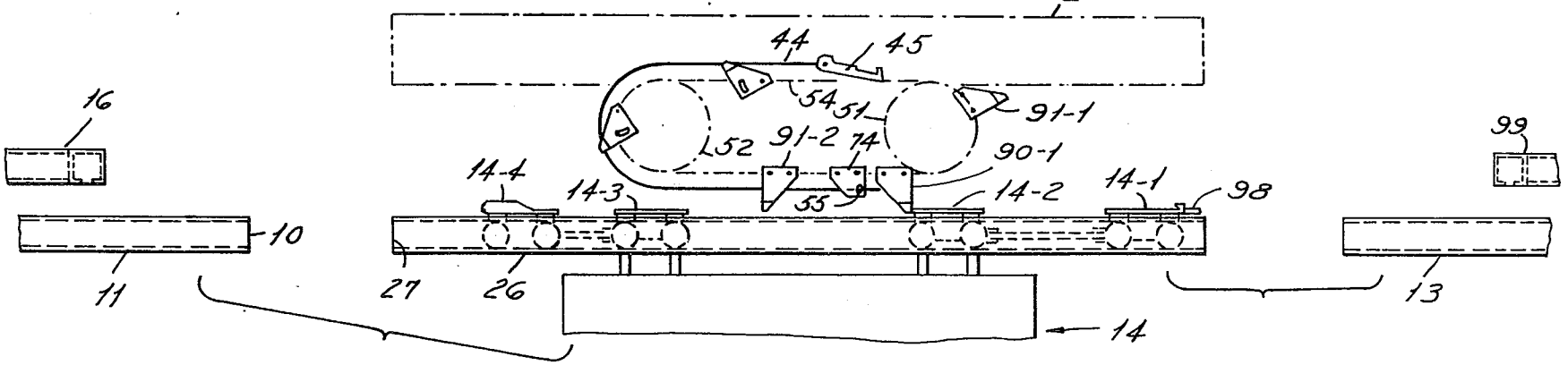
FIG. 8 is a similar elevation showing the carrier on the track section and the track section returned to centered position in elevator.

In FIG. 8, the carrier 14 has been advanced by the pusher member 90-1 until the leading trolley 14-1 has engaged a stop 98, the drive means for the propelling member 44 has been deactivated, and the carriage has been shifted to a centered position on the frame 32, moving the track section 26 and carrier 14 within the elevator 24.

Figure 9:
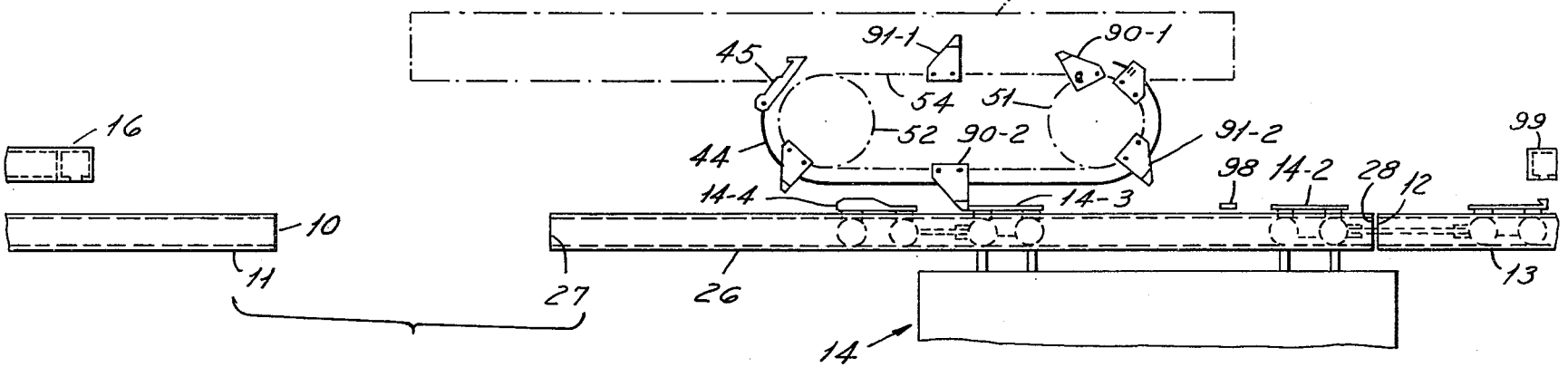
FIG. 9 is a similar elevation showing the track section shifted into registry with the receiving end of a second carrier supporting track and the carrier being advanced onto that track by the propelling mechanism.

FIG. 9 assumes that the elevator has been moved to another level where the carrier 14 is to be transferred to a second or receiving carrier supporting track 13. The carriage has been shifted to the right on the frame 32 to place the exit end 28 of the track section 26 in registry with the receiving end 12 of the second supporting track 13; the stop 98 has been retracted and the drive means for the propelling member 44 has been operated in the forwarding direction. A second pusher member 90-2 on the output chain 54 has engaged the carrier trolley 14-3 and is advancing the carrier onto the second supporting track 13.

Figure 10:
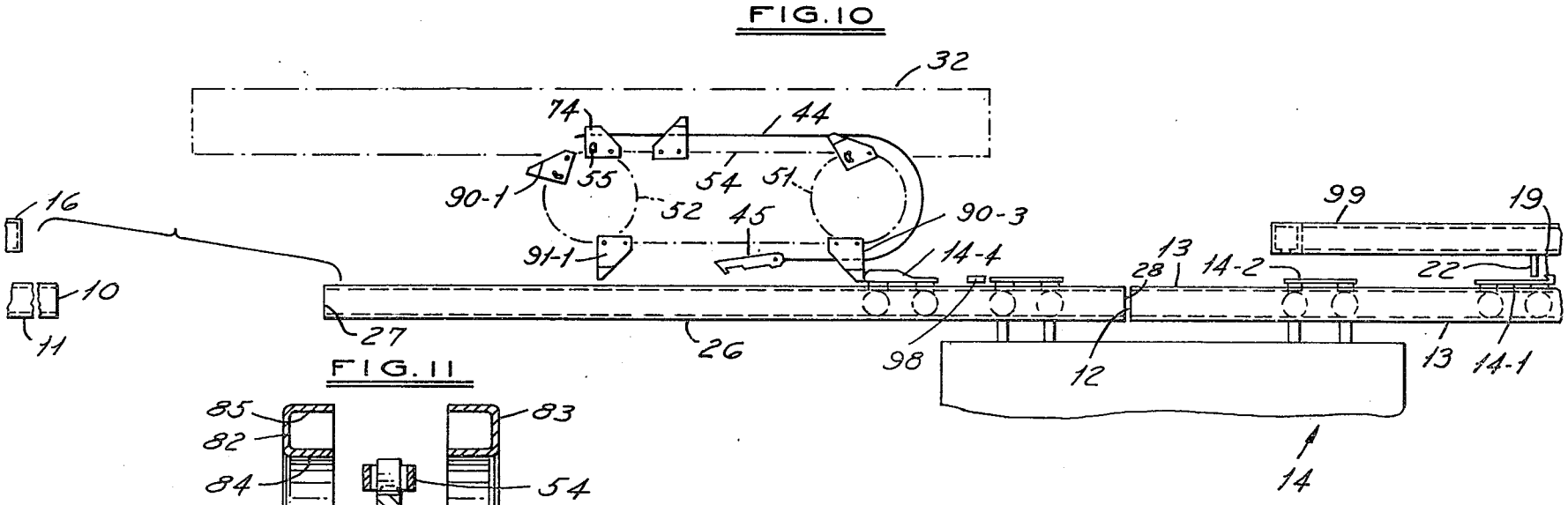
FIG. 10 is a similar elevation showing further advancement of the carrier onto the second carrier supporting track and in position to be engaged by a pusher of a conventional power chain.

In FIG. 10, forwarding operation of the drive means continues and a third pusher member 90-3 on the output chain 54 has engaged the carrier trolley 14-4 and has advanced the carrier 14 to a position in which the dog 19 on the leading trolley 14-1 is engageable by a pusher 22 of the receiving chain, supported by the track 99.

During the propulsion of the carrier by the pusher members 90-1, 90-2 and 90-3, shown in FIGS. 7-10, the propelling member 44 circulates around the endless storage path through the switch 88, moving the switch to open position and connecting the return portion of the storage track with a portion of the track means 46. In FIG. 10, when propulsion of the carrier by the pusher member 90-3 has been completed, the pusher-equipped end 45 of the propelling member 44 has moved beyond the switch 88 which automatically returns to the closed position by action of the counterweight 89. Consequently, when the drive means for the propelling member 44 is next operated in the reverse direction, the pusher-equipped end 45 of the propelling member 44 will be extended in a linear path along the track means 46 as indicated in FIGS. 2 and 5.

Those skilled in the art will appreciate that the propelling mechanism of the invention, consisting of a propelling member movable from storage means to a linear path parallel to a conveyor track section provides a relatively simple mechanical device which will forward a carrier along that track section and which can be extended over the end of an adjacent track to reach out and move a carrier from the adjacent track to the track section. By employing an endless chain as an output member of the drive means for the propelling member and an endless storage path for the propelling member, additional carrier propulsion can be obtained through driving members secured to the endless output member, particularly for carriers having multiple trolleys; and, the driving members on the output chain can be combined with holdback members and spaced on the output member to correspond to the spacing of the multiple trolleys on the track section.

We claim:

1. In a power and free conveyor including a carrier and a carrier supporting track section having an entrance end and an exit end, propelling mechanism for forwarding the carrier along said track section toward the exit end thereof comprising:

a double-ended flexible propelling member, one end of the propelling member being equipped with a carrier pusher;

means for supporting said propelling member including storage means and track means, said track means extending from said storage means toward the entrance end of said track section in parallel relation with said track section and defining for said propelling member a linear path of movement in which said carrier pusher is engageable in forwarding relation with a carrier;

drive means operable in a reverse direction to extend the pusher equipped end of said propelling member from said storage means along said track means toward the entrance end of said track section, and operable in a forwarding direction to return the propelling member to said storage means whereby a carrier engaged by said pusher is forwarded along said track section; and, pusher means operably associated with said drive means for forwarding a carrier along said track section after said propelling member has been returned to said storage means.

2. A power and free conveyor according to claim 1 wherein said drive means includes a pair of sprockets spaced apart longitudinally of said track section, an endless output chain trained about said sprockets, a driving connection from said output chain to said propelling member adjacent the other end thereof, and said storage means comprises storage track means for guiding said propelling member in a storage path of travel parallel to the path of travel of said output chain.

3. A power and free conveyor according to claim 2 wherein said propelling member is a length of chain composed of a series of links connected by pivots.

4. A power and free conveyor according to claim 3 wherein said storage track means extends from said track means and returns to said track means through a switch thereby forming an endless storage path which includes a portion of said track means.

5. A power and free conveyor according to claim 4 wherein the length of said endless storage path exceeds the length of said propelling member chain.

6. A power and free conveyor according to claim 2 wherein said pusher means is carried by said output chain.

7. A power and free conveyor according to claim 6 wherein said output chain is provided with holdback means engageable by a carrier on said track section.

8. A power and free conveyor according to claim 2 wherein said carrier is provided with a plurality of trolleys connected in longitudinally spaced relation and including a leading trolley and at least one trailing trolley, a drive dog on the leading trolley engageable by said carrier pusher of the propelling member, said pusher means being engageable with the trailing trolley.

9. In a power and free conveyor including a carrier and a carrier supporting track section having an entrance and an exit end, propelling mechanism for forwarding the carrier along said track section toward the exit end thereof comprising:

a double-ended flexible propelling member formed by a pair of chains each composed of a series of links connected by pivots, and means for connecting said chains in spaced side-by-side relation, one end of the propelling member being equipped with a carrier pusher carried intermediate said pair of chains by said connecting means;

means for supporting said propelling member including storage means and track means, said track means extending from said storage means toward the entrance end of said track section in parallel relation with said track section and defining for said propelling member a linear path of movement in which said carrier pusher is engageable in forwarding relation with a carrier;

and drive means operable in a reverse direction to extend the pusher-equipped end of said propelling member from said storage means along said track means toward the entrance end of said track section, and operable in a forwarding direction to return the propelling member to said storage means whereby a carrier engaged by said pusher is forwarded along said track section, said drive means including a pair of sprockets spaced apart longitudinally of said track section, an endless output chain trained about said sprockets, a driving connection from said output chain to said propelling member adjacent the other end thereof, said storage means being arranged to guide said propelling member in a storage path of travel parallel to the path of travel of said output chain.

10. A power and free conveyor according to claim 9 wherein said track means and said storage track means each include a pair of tracks each having supporting and guiding rails, said propelling member chains being equipped with rollers mounted on the pivots thereof for engaging said rails.

11. A power and free conveyor according to claim 10 wherein said storage track means extends from said track means and includes a return path which rejoins said track means at a junction to form an endless storage path, switch means mounted at said junction, and means normally urging said switch means to a position in which said junction is closed to said return path.

12. A power and free conveyor according to claim 11 wherein the length of said endless storage path exceeds the length of the propelling member.

13. A power and free conveyor according to claim 12 wherein said output chain is provided with pusher means engageable with a carrier after said propelling member has been returned to said storage means.

14. A power and free conveyor according to claim 13 wherein said output chain is provided with holdback means engageable by a carrier on said track section.

15. In a power and free conveyor including a carrier, a first carrier supporting track having a delivery end, a carrier supporting track section having an entrance end and an exit end;

a carriage to which said track section is attached, means mounting said carriage for movement in directions longitudinal of said track section whereby the entrance end thereof can be placed in registry with the delivery end of said first carrier supporting track;

propelling mechanism for forwarding the carrier from said first carrier supporting track along said track section comprising a double-ended flexible propelling member, one end of the propelling member being equipped with a carrier pusher;

means for supporting said propelling member including storage means and track means, said track means extending from said storage means to the entrance end of said track section and including a portion associated with the delivery end of said first carrier supporting track, said track means extending in parallel relation with said track section and said first carrier supporting track and defining for said propelling member a linear path of movement in which said carrier pusher is engageable in forwarding relation with a carrier;

and drive means operable in a reverse direction to extend the pusher-equipped end of said propelling member from said storage means along said track means and over the delivery end of said first carrier supporting track, and operable in a forwarding direction to return the propelling member to said storage means whereby a carrier engaged by said pusher is forwarded from said delivery end along said track section.

16. A power and free conveyor according to claim 15 further including an elevator and wherein said carriage mounting means are supported by the elevator.

17. A power and free conveyor according to claim 16 further including a second carrier supporting track having a receiving end, and wherein the exit end of said track section is registerable with said receiving end by movements of said elevator and said carriage, and said drive means is provided with pusher means for forwarding a carrier from said track section to said second carrier supporting track.

* * * * *